US005842618A

United States Patent [19]

Julemont et al.

[11] Patent Number: 5,842,618

[45] Date of Patent: Dec. 1, 1998

[54] DISPENSING CLOSURE WITH CONTROLLED VALVE ACTUATION

[75] Inventors: Jean Julemont, Verviers, Belgium; Patrick Connan, Lebanon, N.J.

[73] Assignee: Colgate-Palmolive Company, New York, N.Y.

[21] Appl. No.: 413,584

[22] Filed: Mar. 30, 1995

[51] Int. Cl.[6] ..... B65D 37/00

[52] U.S. Cl. ..... 222/490; 222/153.07; 222/494

[58] Field of Search ..... 222/212, 213, 222/490, 491, 494, 153.07

[56] References Cited

U.S. PATENT DOCUMENTS

| | | | |
|---|---|---|---|
| 1,972,344 | 9/1934 | Jackson | 222/494 |
| 2,005,642 | 6/1935 | Thornton . | |
| 2,175,052 | 10/1939 | Bull et al. . | |
| 2,730,274 | 1/1956 | Brown | 222/490 |
| 2,758,755 | 8/1956 | Schafler . | |
| 3,490,658 | 1/1970 | Schwartzman | 222/494 X |
| 3,726,436 | 4/1973 | Despain et al. | 222/494 X |
| 3,754,690 | 8/1973 | Marchant | 222/494 |
| 3,949,934 | 4/1976 | Goglio | 222/494 X |
| 4,161,288 | 7/1979 | McKinney | 222/494 X |
| 4,728,006 | 3/1988 | Drobish et al. | 222/181 |
| 4,749,108 | 6/1988 | Dornsbusch et al. | 222/212 |
| 4,785,978 | 11/1988 | Kano et al. | 222/494 X |
| 5,005,737 | 4/1991 | Rohr | 222/212 |
| 5,012,956 | 5/1991 | Stoody | 222/494 X |
| 5,033,647 | 7/1991 | Smith et al. | 222/494 X |
| 5,071,017 | 12/1991 | Stull | 222/494 X |
| 5,105,985 | 4/1992 | Kroeber | 222/107 |
| 5,115,950 | 5/1992 | Rohr | 222/490 |
| 5,169,030 | 12/1992 | Lewin | 222/92 |
| 5,213,236 | 5/1993 | Brown et al. . | |
| 5,234,138 | 8/1993 | DeLaforcade | 222/490 |
| 5,271,531 | 12/1993 | Rohr et al. | 222/212 |
| 5,271,533 | 12/1993 | Joulia | 222/402.13 |
| 5,301,850 | 4/1994 | Gueret | 222/494 |
| 5,307,955 | 5/1994 | Viegas | 222/107 |
| 5,325,999 | 7/1994 | Gueret | 222/212 |
| 5,390,805 | 2/1995 | Bilani et al. | 222/490 X |

FOREIGN PATENT DOCUMENTS

| | | |
|---|---|---|
| 0278125 | 8/1988 | European Pat. Off. . |
| 0395380 | 10/1990 | European Pat. Off. . |
| 0586778 | 3/1994 | European Pat. Off. . |
| 0160336 | 11/1995 | European Pat. Off. . |

*Primary Examiner*—Kevin P. Shaver
*Attorney, Agent, or Firm*—Michael J. McGreal

[57] ABSTRACT

Self-sealing membrane valves can be used with containers where storage between uses is in an upright orientation if the product in the container on the underside of the membrane valve is drained from the membrane valve. This will prevent product droplets from being expelled from the valve as it rapidly opens. In addition, it is useful to have a structure on the exterior of the membrane valve to control the rate of opening of the valve during the dispensing operation. The membrane valve is drained on the underside by use of a plurality of appendages that are adjacent the underside of the valve and by the use of a diaphragm adjacent the upper side of the valve to control the rate of opening of the valve.

28 Claims, 6 Drawing Sheets

DISPENSING CLOSURE WITH CONTROLLED VALVE ACTUATION

FIELD OF THE INVENTION

This invention relates to improvements to self-sealing membrane closures. More particularly, this invention relates to a structure for self-sealing membrane valves which controls the speed of fluid flow and safety of these closures by minimizing the ejection of small droplets of product prior to delivery of the main product stream and providing increased control over the main product stream.

BACKGROUND OF THE INVENTION

Many different types of containers are presently available for packaging non-solid products of the type which are capable of flowing, such as fluid or fluidized materials, including liquids, pastes, powders, and the like, which substances are collectively and generically referred to as "fluids". Some of these packages include a dispenser which opens when the container is squeezed, to allow fluid to be discharged from the package, and automatically reseals when the pressure inside the container is reduced. The most convenient and useful type of closure for such containers is a self sealing membrane valve. This can be of the retracting type or the non-retracting type. In the retracting type the valve first moves upwardly and then opens upon the application of additional pressure on the bottle. When the pressure is released the valve retracts and closes. In the non-retracting type the membrane valve remains essentially stationary and opens and closes upon the application and the release of pressure.

Self sealing membrane closures are designed to open and close at predetermined dispensing pressures. This is the squeeze pressure on the bottle. In order to permit the safe manipulation of these containers even in an inverted position or for the container to drop without dispensing any fluid, usually the opening pressure is preset at a high level by selecting the right combination of valve convexity, thickness of material and length of membrane slits.

However, when preset at a higher pressure there are the disadvantages in that:

it will induce a high velocity to the fluid, especially with fluids of low viscosity, i.e. below 100 cps, when the container is squeezed and the valve opens, with the risk of dispensing excess of fluid or the fluid in an uncontrolled manner.

when the container is squeezed in an approximately upright position, the container inner gaseous atmosphere can be expelled, with the risk of having droplets of fluid sprayed at the same time. This is the result of the inner lower surface of the valve collecting a wetting layer and droplets of the contained fluid, at the proximity of the membrane aperture. This rapid expelling in the nature of a "spitting" can soil clothing or stain fixtures or even be dangerous.

Self-sealing membrane valves which are used on containers that can be used in an upright position or in an inverted position are illustrated in U.S. Pat. No. 5,213,236 and in U.S. Pat. No. 5,307,955. These patents disclose self-sealing membrane valves of the retracting type that are useful for dispensing products such as lotions, shampoos,. conditioners, liquid soaps, shower gels, bath gels and related products. Both of these patents show self-sealing membrane valves being used on containers where the contents are dispensed while the container is in an inverted orientation. The membrane valves in each of these patents will have a rapid expelling and a "spitting" problem if there is dispensing while the container is in an upright orientation. European Patent Application 586,778 A1 discloses a self-seal valve for an upright dispensing container. This container is stored in an upright orientation. When it is desired to discharge a portion of fluid, a person will squeeze and tilt the container. Usually the container will not be fully tilted until the valve is in the extended, non-retracted position. At this point, a person more completely tilts the container and dispenses a controlled portion of the fluid. In this container and closure there will be a spitting problem unless the container is inverted so that the fluid in the container is in contact with the underside of the valve prior to the valve fully extending from its retracted position and opening. However, if used in this way it is difficult to control the amount of fluid that is dispensed. Most likely an excess amount of fluid will be dispensed.

The present invention solves the problems associated with the high velocity of fluids and gases expelled from slit membrane valves as droplets and the control of the amount of fluid dispensed. The present invention sets out a valve structure where an additional exterior flange structure constrains the membrane in such a manner that it releases the fluid at a lower speed, and an internal structure which continually drains fluid from underside of the self-sealing membrane valve, when the container is in the upright orientation, thus preventing droplets to be sprayed when the product is to be dispensed. This structure is particularly useful with retractable membrane valves.

BRIEF SUMMARY OF THE INVENTION

The present invention is directed to an improvement in self-sealing membrane valves. These can be of the retracting or of the non-retracting type. The present invention provides for the:

improved controlled delivery of fluids especially of low viscosity, avoiding overdelivery and reducing jet velocity, thus better controlling how the fluid is dispensed onto the receiving surface, and improved safety by reducing the risk of ejecting or spraying fine fluid particles when the container is squeezed in an upright position.

The dispensing valve is comprised of a flexible membrane which has at least one openable segment therethrough. This openable segment responds to the pressure of the substances to be dispensed by moving from a closed first position to an open second position. This flexible membrane is at least partially surrounded by a substantially non-flexible first flange, or equivalent structure, which maintains the first flexible membrane in a fixed position. Depending downwardly from this flange, or an equivalent structure, is at least one appendage which terminates in a close relationship to the underside of the flexible membrane, and at a lower point of the flexible membrane. In addition, the appendage preferably has a point that is lower in orientation than the end that is in a close relationship to the underside of the flexible membrane. This close relationship can be a contacting relationship. At the least it must provide a capillary action between the flexible membrane and the appendages for the fluid on the underside of the flexible membrane to drain onto the appendages. Preferably, there are a plurality of appendages. In addition, the appendages can converge or diverge or can be fully or partially connected at the terminal ends to provide a greater contact area of the appendages with the flexible member.

The structure to control the fluid speed through the orifice comprises an outside substantially non-flexible second flange which is elevated above the flexible membrane and is contacted by the flexible membrane while the slits in the flexible membrane are in the process of opening. This second flange preferably has an upper structure comprising a diaphragm portion which restricts and controls the upward movement of the flexible membrane when it is pushed by the inner pressure, and an aperture that will allow the passage of the fluid. Depending upon the profile of the diaphragm of the second flange and its relative height versus the open position of the flexible membrane, the result is a reduction in flow rate and flow speed. Also, the height of the second flange above the flexible membrane can be adjustable so that fluid flow can be adjusted for various fluid viscosities.

The valve can be attached to a container through threads on a peripheral skirt on the first or second flange and complementary threads on the neck of a container. Various other techniques can be used to connect the self-sealing membrane valve to the container including a direct heat or adhesive bonding to the exit of the container.

DETAILED DESCRIPTION OF THE INVENTION

It has been noted that there is a problem in using self-sealing membrane valve closures on containers where dispensing is to take place while the container is in an orientation where the valve is not being fully contacted by the fluid contents of the container. It has been noted that the inconvenience of using self-sealing membrane valve closures can be too high a velocity of the fluid that is expelled from a container, especially with low viscosity fluids, as well as a risk of droplet projection when the container is squeezed in an upright or near upright position. Droplet projection is caused by fluid on the undersurface of the flexible membrane and too fast an opening of the flexible membrane. This fluid is rapidly expelled as droplets when the valve is opened. This is solved by including a means to control the opening phase of the valve and/or a means to drain the fluid remaining on the inner surface of the flexible membrane.

Figure 1:
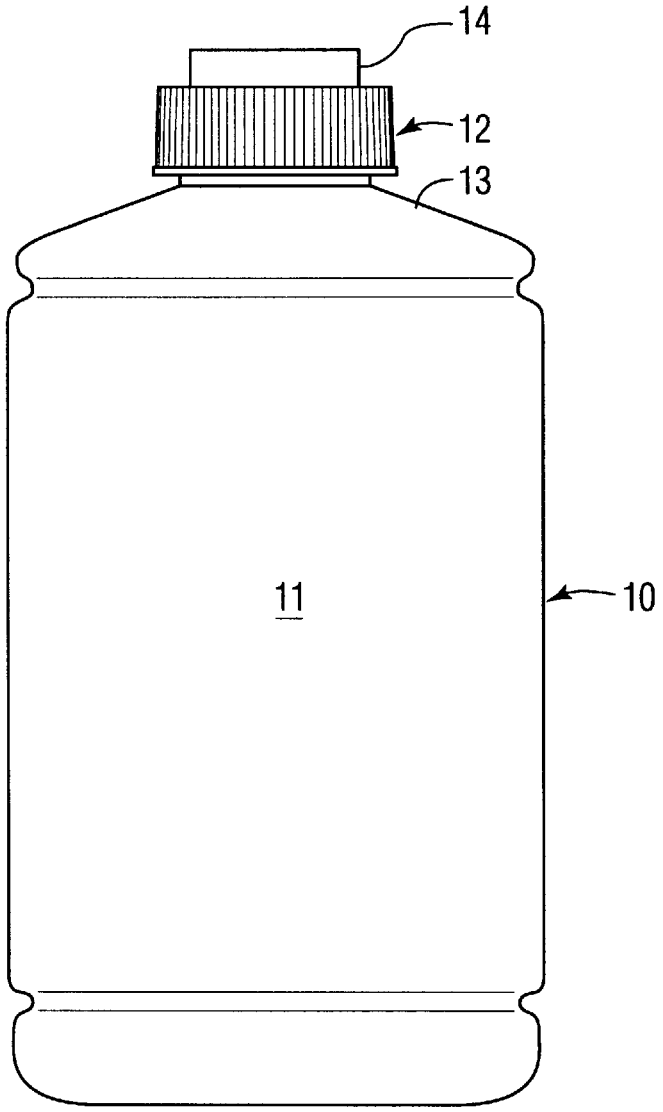
FIG. 1—is an elevational view of the self-sealing membrane valve closure on a container.

In FIG. 1 there is shown a typical squeezable container 10 which uses a self-sealing membrane valve closure. This can be a retractable or a non-retractable self sealing membrane. The body portion of this container is 11 and the shoulder portion 13. A closure 12 seals the container. The closure 12 typically comprises a main cap body, a flexible slotted membrane valve, and retaining means to maintain the membrane valve in place. Cover 14 is a removable protective seal for the self-sealing membrane valve. This is removed for dispensing.

Figure 2:
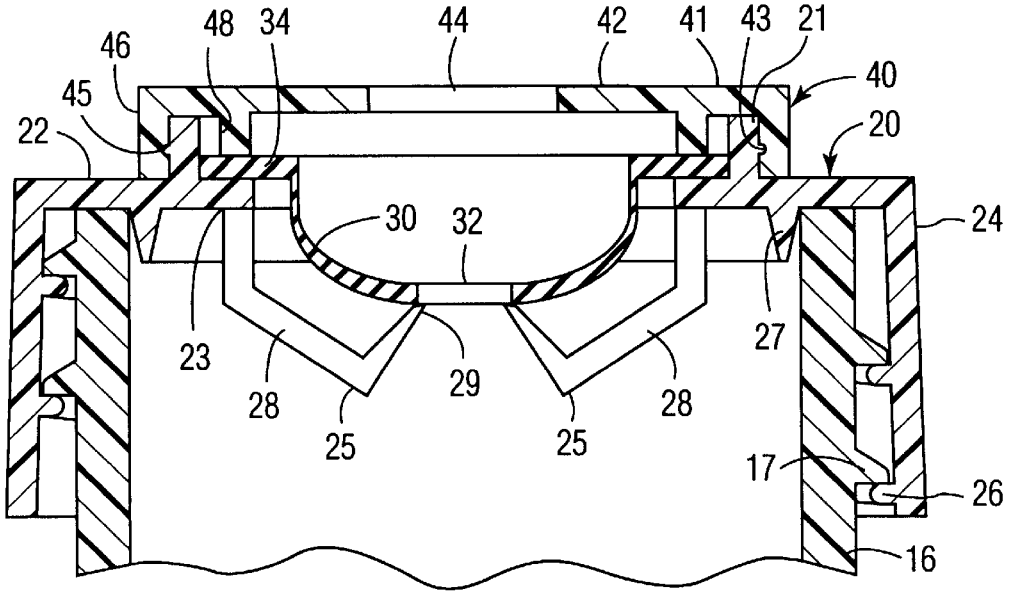
FIG. 2—is a cross-sectional view of the self-sealing membrane valve closure on a container.

FIG. 2 is a cross-sectional view of the closure 12 on the neck 16 of a container. The closure consists of first flange 20 which has a downwardly depending skirt 24. On the inner surface of this skirt are threads 26 which threadedly engage threads 17 of the container neck. Flange 20 has a planar section 22 which has a downwardly depending sealing rib 27. Inward of the sealing rib is an aperture in which the flexible member 30 is mounted and through which it projects during dispensing. This flexible member is supported by first flange 20 and is shown mounted downwardly into the container. This is in the non-dispensing position. In a dispensing orientation it can project up to about an equal distance upwardly above planar section 22. Segments 32 define a self-sealing opening.

Depending from the lower surface of planar section 22 are a plurality of appendages 28. A first end 23 of the appendages is attached to the planar section and a second end 29 is in a close relationship with the underside of the flexible member 30. Preferably this is a contacting or near contacting relationship. The second end 29 at least has to be sufficiently close to the underside of the flexible member to drain fluids from the underside of the flexible member by capillary action. Preferably the second ends of the appendages are within about 5 mm or less of the underside of the flexible member. The appendages 28 preferably have a lower portion 25 for collecting by gravity or capillary action the fluid from the underside of the flexible membrane so that they can fall as droplets back into the container when the container is standing unused. This is a preferred embodiment.

Peripheral portion 34 of the flexible member attaches to first flange 20, either mechanically or adhesively. In FIG. 2 the portion 34 is shown to be mechanically attached to the first flange. This is accomplished by second flange 40 which is rotatably attached to upwardly extending rim 21 of flange 20. An interfitting groove 43 and rib 45 arrangement can be used to attach second flange 40 to upwardly extending rim 21. This also allows second flange 40 to rotate on first flange 20 and around the vertical axis of the closure. The second flange 40 as shown has a planar portion 41 which extends into a planar portion 42. It is preferred that this portion 42 be planar in shape but it can be convex or concave. The planar portion 42 has an aperture 44. This aperture can be round, elliptical or another shape. Downwardly extending rim 48 is shown contacting the peripheral portion of the flexible member. This provides for a mechanical attachment of the flexible member to the remainder of the closure. A peripheral skirt 46 depends downwardly from the planar section 41.

Figure 3:
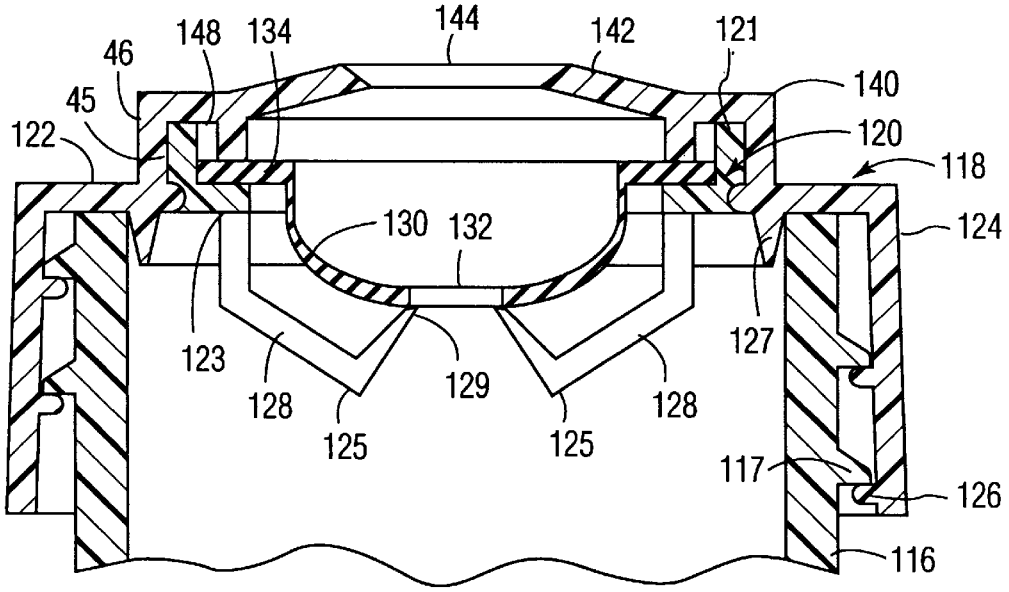
FIG. 3—is an alternate embodiment of the self-sealing membrane valve of FIG. 2.

FIG. 3 discloses an alternate embodiment to that of FIG. 2. In this embodiment, the second flange 140 is an integral part of the main body of the closure with first flange 120 interfitting onto the main body of closure 12 by a rib and groove interfit attachment as in FIG. 2. An adhesive or heat bonding attachment also can be used. The remainder of the closure is essentially the same as in FIG. 2. As shown in FIG. 3 the closure is on the neck 116 of a container. The closure consists of first flange 120 which supports the flexible member. The underside of the first flange has appendages 128 depending from the lower surface. These are connected to the first flange at 123 and are in a close relationship to flexible membrane 130 at 129. The flexible membrane has a slit opening 132. The appendages preferably have a lower point 125. The peripheral portion 134 of the flexible membrane is secured to planar section 122 adhesively or mechanically. In this embodiment second flange 140 and planar section 122 are an integral part with skirt 124 depending from planar section 122. Threads 126 on the inner surface of skirt 124 engage thread 117 on the bottle neck. The upper surface 142 of the second flange has an aperture 144. Downwardly extending rim 148 contacts the peripheral portion 134 of the flexible membrane to mechanically hold it in place. The first flange 120, as noted, is attached at 131 by a rib and groove arrangement to the main body 118 of the closure.

Figure 4:
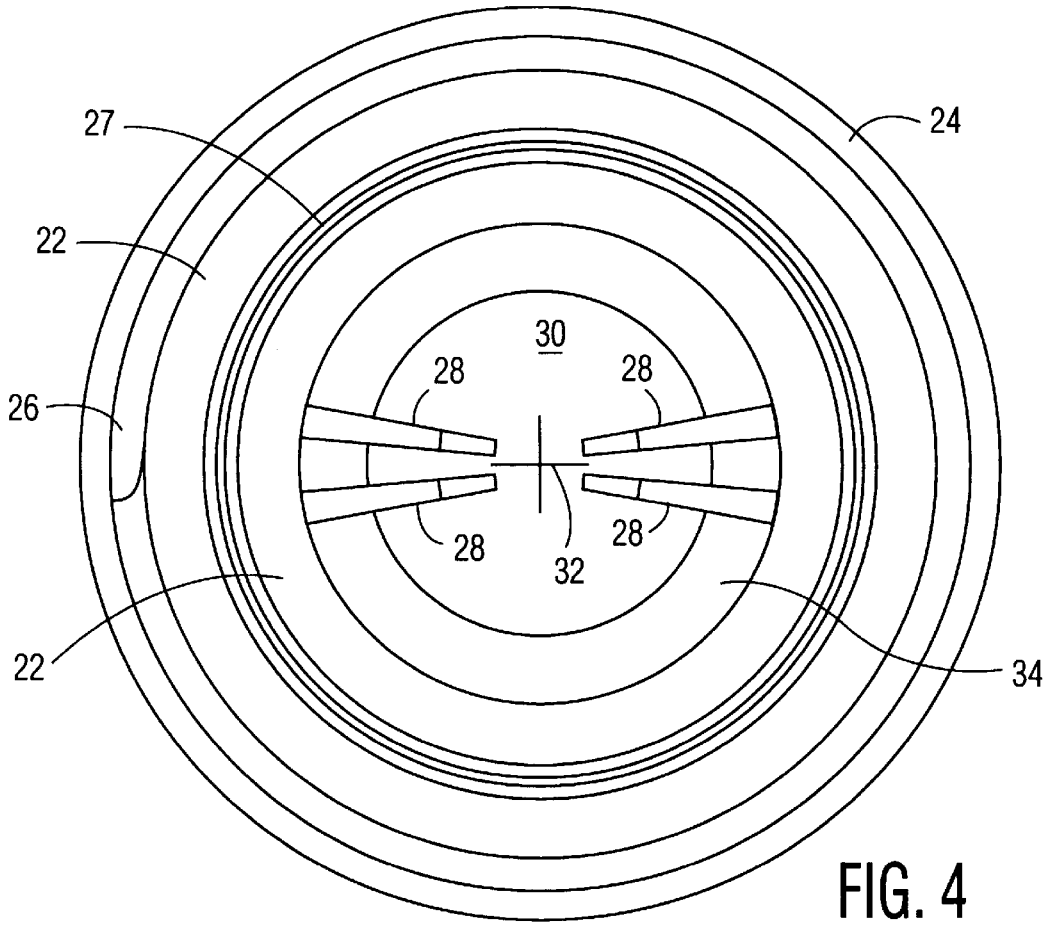
FIG. 4—is bottom plan view of the self-sealing membrane valve closure.
Figure 5:
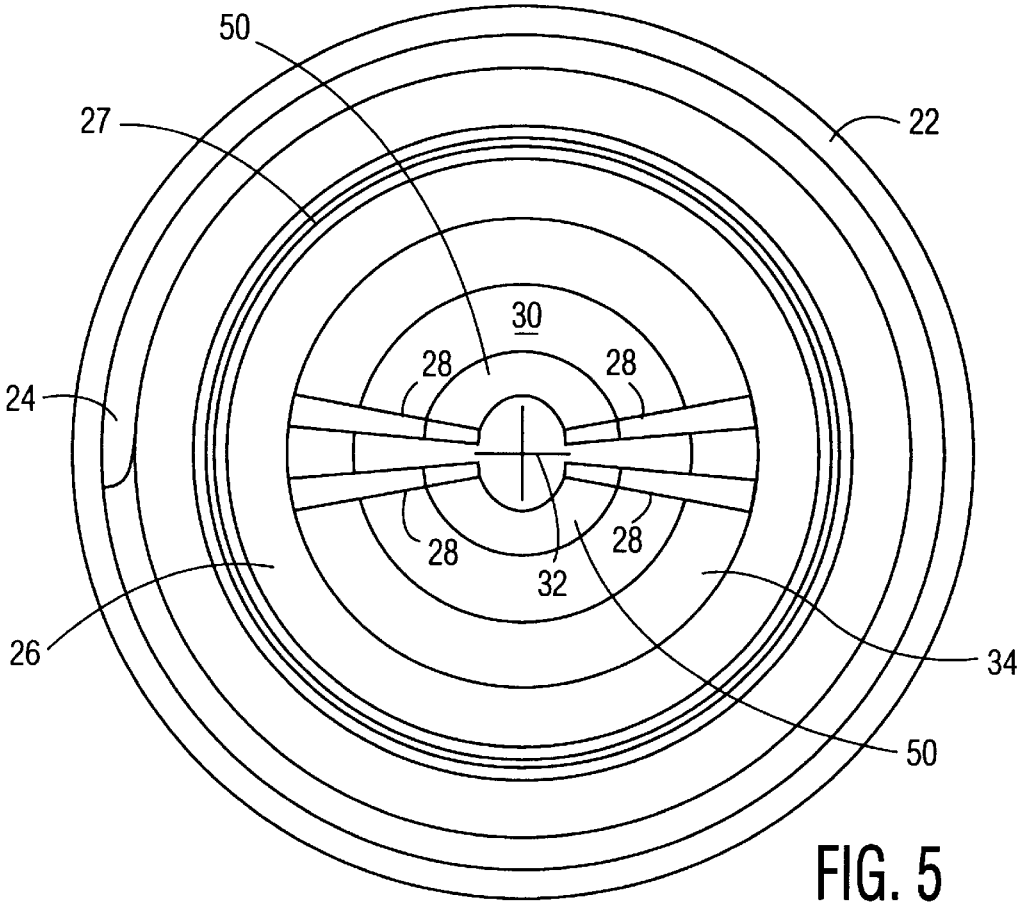
FIG. 5—is a bottom plan view of an alternate embodiment of the self-sealing membrane valve closure showing appendages connected at the second end.
Figure 6:
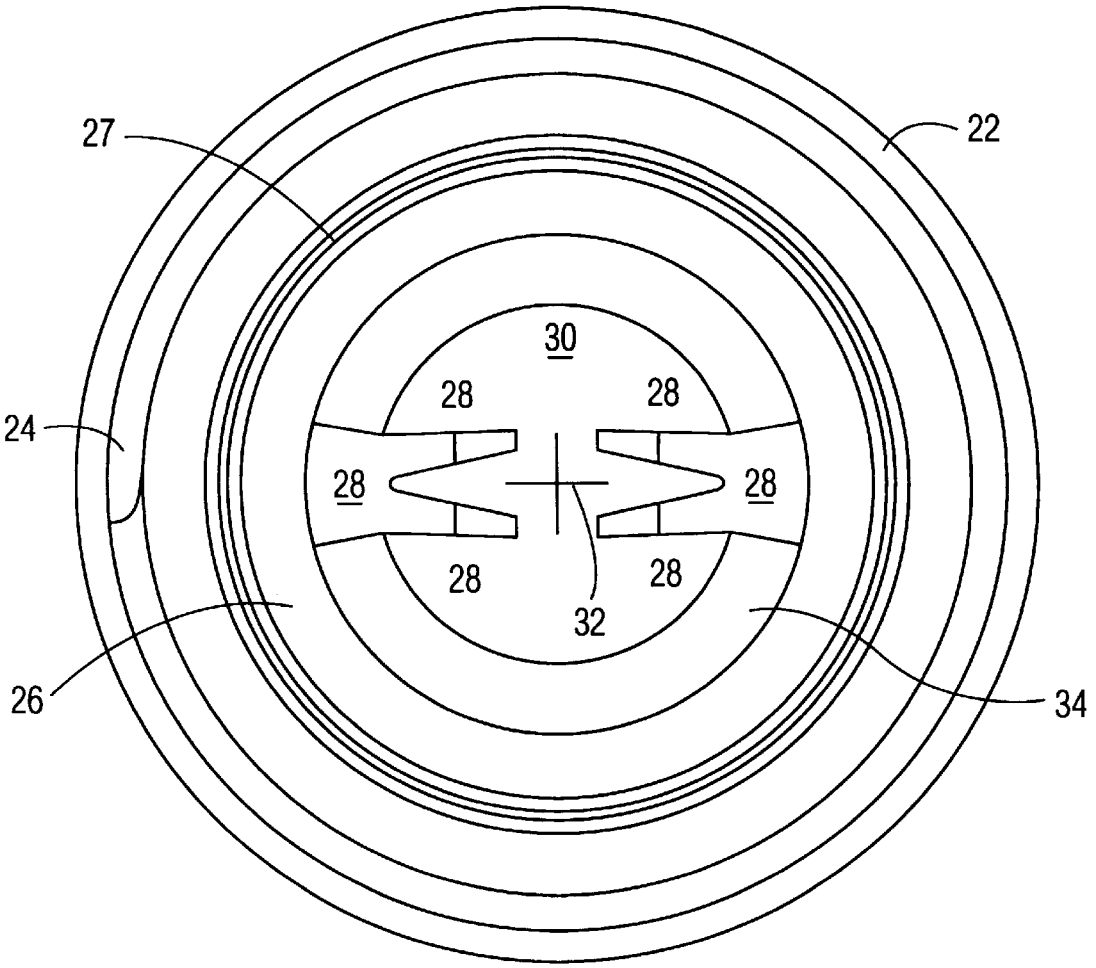
FIG. 6—is a bottom plan view of another alternate embodiment of the self-sealing membrane valve closure with the appendages diverging at the second end.

FIG. 4 shows a bottom view of the closure of FIG. 2. The relative position and space between the appendages 28 can be designed so as to maximize the capillary effect with a range of fluid and material surface tension characteristics. In this embodiment the appendages 28 are shown as separate segments. However, appendages 28 can be forked as shown in FIG. 4, or interconnected as shown in FIG. 5, or diverging as shown in FIG. 6. In FIG. 5 the appendages are interconnected at their second end by means of semicircular segments 50. This embodiment provides for greater contact with the underside of the flexible member 30. In FIG. 6 the appendages 28 diverge from base 29.

Figure 7:
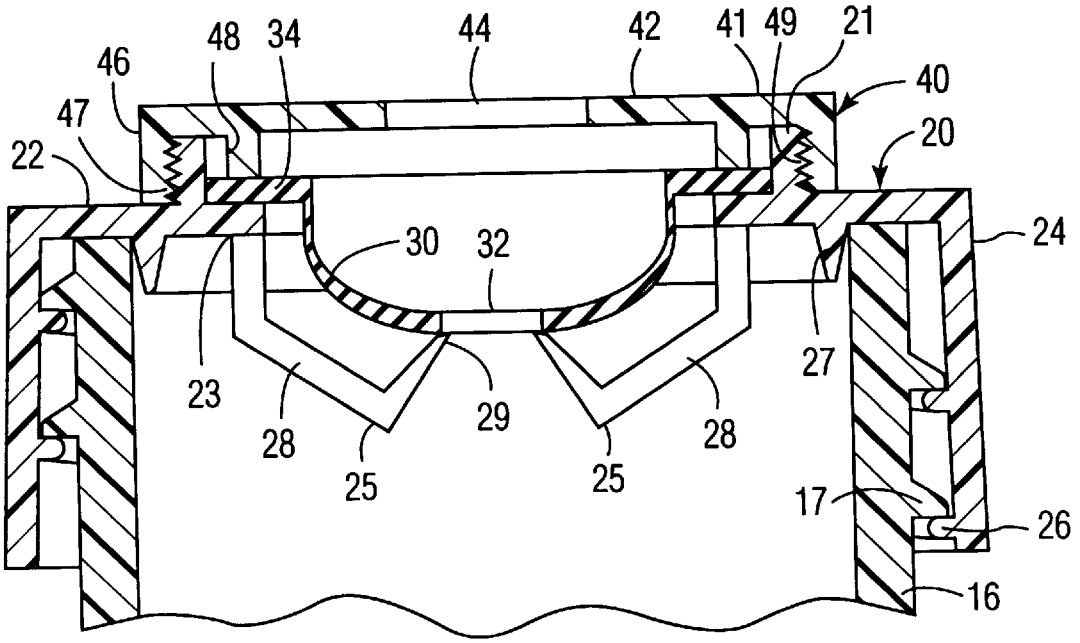
FIG. 7—is a cross-sectional view of the self-sealing membrane closure where the second flange is adjustable.

In FIG. 7 there is disclosed a modification of FIG. 2. In this embodiment, threads 47 on second flange 40 attach this flange to upwardly extending rim 21 by means of threads 49 on rim 21. Retainer 53 is friction fitted within rim 21 and retains the flexible member in place. The flexible member also can be adhesived in place. As a result second flange 40 can rotate around upwardly extending rim 21, that is, it can rotate around the vertical axis and simultaneously move upwardly. In this way the portion 42 and the aperture 44 can be adjusted upwardly and downwardly which will alter the point of contact of second flange 40 with the flexible member, and in particular with its slits during dispensing. As a result the rate of opening of the self-sealing membrane valve can be adjusted for the particular fluids.

Figure 8:
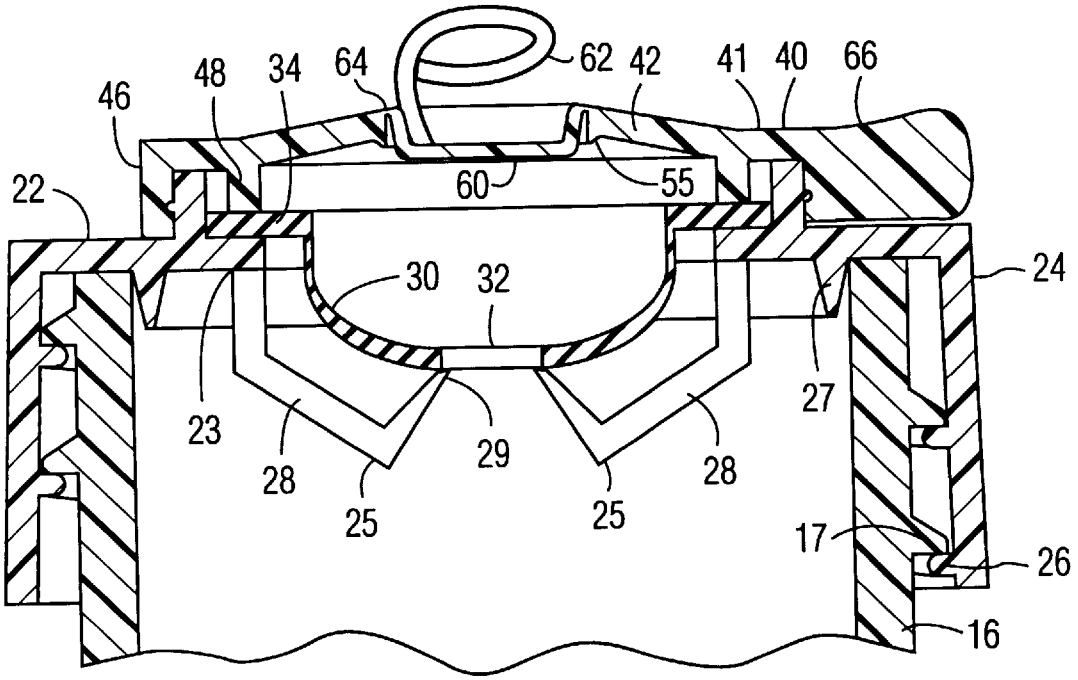
FIG. 8—is a cross-sectional view of the self-sealing membrane closure with a tamper evident seal.

In FIG. 8 the aperture 44 is closed by a tamper evident seal 60. The tamper evident feature 60 prevents the full extension and opening of the flexible member 30. This will secure the closure during transport and distribution. The seal 60 can be removed by the consumer prior to the first use by pulling on the tab 62 to break bridges 64 which attach the seal to the closure. Tab 66 is used to rotate second flange 40. By rotating flange 40, and the shape and location of the membrane slits the opening of the membrane, valve can be controlled and thus the dispensing can be controlled.

Figure 9:
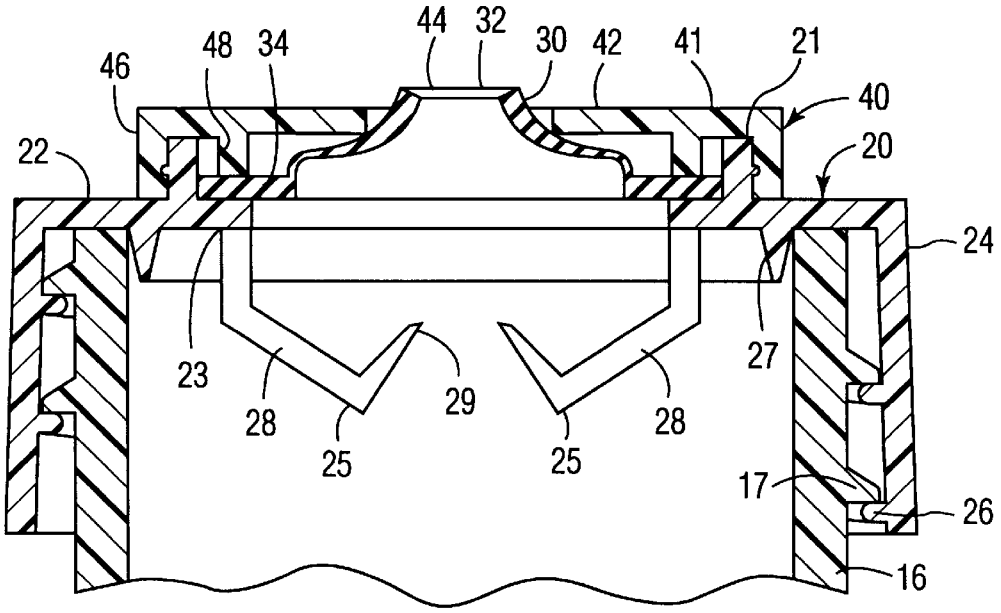
FIG. 9—is a cross-sectional view of the self-sealing membrane closure with the valve in a dispensing condition.

In FIG. 9 the self-sealing membrane valve is shown in a dispensing orientation. The membrane 30 is extended into contact with portion 42. At this point the slit membrane opens and dispenses some of the liquid in container 16. The rate of dispensing can be controlled by changing the height of the portion 42 above the peripheral portion 34 of the flexible member, the diameter of portion 42 or the shape of the aperture and position of the membrane slits. Full extension is when the flexible member has moved the maximum distance upwardly and dispensing is to start.

Figure 10:
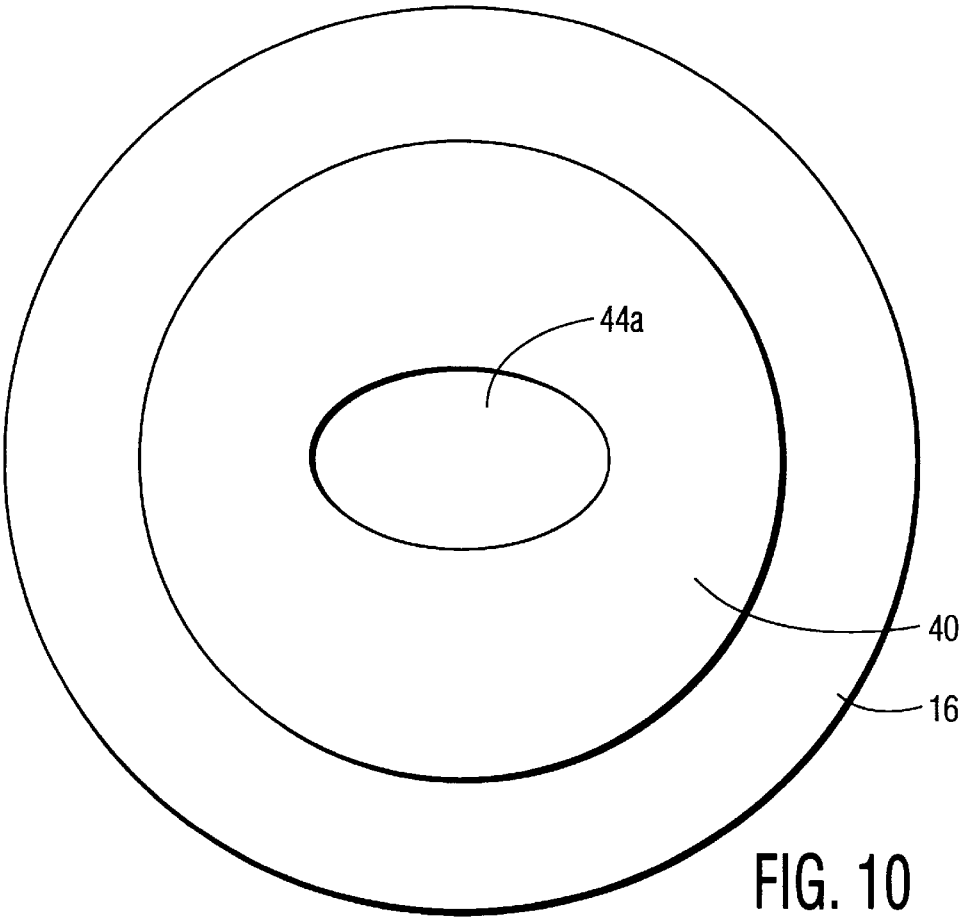
FIG. 10—FIG. 10 is a top plan view of the self-sealing membrane where the second flange has an elliptical aperture.

In FIG. 10 there is shown an embodiment where the second flange 40 has an elliptical aperture 44 (*a*). When the flange 40 is rotated, the rate of opening of the slits will be determined by the position of the slits of the membrane with respect to the flange 40. By positioning the slits with respect to the shaped aperture, the rate of dispensing from the container can be adjusted. In the embodiment of FIG. 7 second flange 40 is shown as threadily adjustable upwardly and downwardly with respect to the flexible member 30. This will adjust the point at which in the upward extension of the flexible member it will contact the second flange. The shape and position of the second flange will control the extension of the valve and the dispensing of product from the container. The positional relationship changes via the position of the aperture and the flexible membrane, the height of the aperture above the flexible membrane and the shape of the aperture with respect to the slits of the membrane.

When this dispensing container is at rest in the upright position, liquids on the underside of the flexible member will be drained back into the container. At the time the container is to be used, it is picked-up and tilted. Even if an unwanted squeeze above the dispensing pressure occurs, which causes the flexible member to move upwardly when a retracting flexible membrane is used and the segments to open there will be no or very little spraying of droplets. Since most of the fluid on the underside of the valve has been drained, the risk of significant "spitting" of fluid is greatly reduced. Once the consumer has tilted the container and deliberately squeezes the container, the flexible membrane moves outwardly and contacts the second flange. Above a predetermined pressure, the flexible member segments will open in a controlled manner, and a portion of fluid will be dispensed.

Once pressure applied to the container decreases, the valve closes and retracts, in a position where the appendages are in close relationship with the flexible member. The container normally will be stored upright, where the appendages will contribute to drain the fluid even from the underside surface of the flexible member.

The closure can be constructed of different plastics. The more rigid portions are constructed of portions consisting of plastics such as polyethylene, polypropylene, polybutadiene, various copolymers of these polymers, polyethylene terephthalate or other polyesters. The flexible membrane is an elastic material such as silicone rubbers, natural rubbers, polyurethanes, ethylene vinylacetates and styrene-butadiene copolymers. Silicone rubbers are preferred for the construction of the flexible membrane.

The present invention has been disclosed in detail. However, the invention includes all variations of this closure design which are based on the disclosure herein.

We claim:

1. A dispensing valve for a package comprising:

a flexible member having at least one openable segment therethrough, said openable segment responding to the pressure of the substance to be dispensed by moving from a closed first position to an open second position;

a substantially non-flexible support substantially surrounding said flexible member for maintaining said flexible member in a fixed position;

at least one appendage extending downwardly from a first side of said non-flexible support, an end of said appendage terminating in a close relationship with said flexible member at a low region of an underside of said flexible member.

2. A dispensing valve as in claim 1 wherein the end of said appendage is in a capillary action relationship with the low region of said flexible member.

3. A dispensing valve as in claim 1 wherein said appendage has a portion extending below said end.

4. A dispensing valve as in claim 2 wherein there are a plurality of appendages and said appendages converge or diverge at said end.

5. A dispensing valve as in claim 1 wherein there are a plurality of appendages and at least some of said appendages are connected at said end.

6. A dispensing valve as in claim 1 including a substantially non-flexible flange having an aperture therein and located above said flexible member for contacting said flexible member on the side opposite to that of said appendages, said second substantially non-flexible flange contacting said flexible member when a substance is being dispensed from said package.

7. A dispensing valve as in claim 6 comprising means to adjust the positional relationship between said substantially non-flexible flange and said flexible member.

8. A dispensing package for fluid products comprising:

a container having a discharge opening;

a flexible member having at least one openable segment therethrough said openable segment responding to the pressure of the substance to be dispensed by moving from a closed first position to an open second position;

a substantially non-flexible support substantially surrounding said flexible member for maintaining said flexible member in a fixed position;

said substantially non-flexible support having means for attachment to the discharge opening of said container;

at least one appendage extending downwardly at a first side from said non-flexible support, an end of said appendage terminating in a close relationship with said flexible member at a low region of an underside of said flexible member.

9. A dispensing package as in claim 8 wherein the end of said appendage is in a capillary action relationship with the low region of said flexible member.

10. A dispensing package as in claim 8 wherein said appendage has a portion extending below said end.

11. A dispensing package as in claim 8 wherein there are a plurality of appendages and said appendages converge or diverge at said end.

12. A dispensing package as in claim 8 wherein there are a plurality of appendages and at least some of said appendages are connected at said end.

13. A dispensing package as in claim 8 including a substantially non-flexible flange having an aperture therein and located above said flexible member for contacting said flexible member on the side opposite to that of said appendages, said second substantially non-flexible flange contacting said flexible member when a substance is being dispensed from said container.

14. A dispensing package as in claim 13 comprising means to adjust the positional relationship between said substantially non-flexible flange and said flexible member.

15. A dispensing valve for a package comprising:

a flexible member having at least one openable segment therethrough, said openable segment interiorly located on said flexible member and responding to the pressure of the substance to be dispensed by moving from a closed first position to an open second position;

a substantially non-flexible support flange substantially surrounding said flexible member and said openable segment for maintaining said flexible member in a fixed position, said openable segment free of contact with said support flange; and a substantially non-flexible flange having an aperture therein in alignment with said openable segment and mounted above said flexible member for contacting said flexible member when a substance is being dispensed from said package to thereby control the movement of said flexible member.

16. A dispensing valve as in claim 15 comprising means to adjust the positional relationship of said non-flexible flange above said flexible member.

17. A dispensing valve as in claim 15 wherein there is at least one appendage extending downwardly from a first side of said non-flexible support, an end of said appendage terminating in a close relationship with the low region of said flexible member.

18. A dispensing valve as in claim 15 wherein the other end of said appendage is in a capillary action relationship with the low region of said flexible member.

19. A dispensing valve as in claim 17 wherein said appendage has a portion extending below said end.

20. A dispensing valve as in claim 17 wherein there are a plurality of appendages and said appendages converge or diverge at said end.

21. A dispensing valve as in claim 17 wherein at least some of said appendages are connected at said other end.

22. A dispensing package for fluid products comprising:

a container having a discharge opening;

a flexible member having at least one openable segment therethrough said openable segment interiorly located on said flexible member and responding to the pressure of the substance to be dispensed by moving from a closed first position to an open second position;

a substantially non-flexible support flange substantially surrounding said flexible member for maintaining said flexible member in a fixed position, said openable segment free of contact with said support flange;

said substantially non-flexible support flange having means for attachment to the discharge opening of said container; and a substantially non-flexible flange having an aperture therein in alignment with said openable segment and mounted above said flexible member for contacting said flexible member when a substance is being dispensed from said package to thereby control the movement of said flexible member.

23. A dispensing package as in claim 22 comprising means to adjust the positional relationship of said non-flexible flange above said flexible member.

24. A dispensing package as in claim 22 wherein there is at least one appendage extending downwardly from a first side of said non-flexible support, an end of said appendage terminating in a close relationship with the low region of said flexible member.

25. A dispensing package as in claim 24 wherein the end of said appendage is in a capillary action relationship with the low region of said flexible member.

26. A dispensing package as in claim 24 wherein said appendage has a portion extending below said end.

27. A dispensing package as in claim 24 wherein there are a plurality of appendages and said appendages converge or diverge at said end.

28. A dispensing package as in claim 24 wherein there are a plurality of appendages at least some of said appendages are connected at said end.

* * * * *